US005112199A

United States Patent [19]

Otaki et al.

[11] Patent Number: 5,112,199

[45] Date of Patent: May 12, 1992

[54] FLUID PUMP UNIT WITH FLOW CONTROL VALVE

[75] Inventors: Mizuo Otaki; Miyoko Hamao, both of Kanagawa, Japan

[73] Assignee: Atsugi Unisia Corporation, Kanagawa, Japan

[21] Appl. No.: 587,667

[22] Filed: Sep. 25, 1990

[30] Foreign Application Priority Data

Sep. 26, 1989 [JP] Japan ..... 1-112195[U]

[51] Int. Cl.[5] ..... F04B 49/00

[52] U.S. Cl. ..... 417/310; 417/307; 417/309

[58] Field of Search ..... 417/310, 309, 307

[56] References Cited

U.S. PATENT DOCUMENTS

| | | | |
|---|---|---|---|
| 4,213,744 | 7/1980 | Davis et al. | 417/310 |
| 4,473,341 | 9/1984 | Ohe et al. | 417/299 |
| 4,498,853 | 2/1985 | Sakamaki et al. | 417/310 |
| 4,557,670 | 12/1985 | Inagaki et al. | 417/310 |
| 4,564,338 | 1/1986 | Ilg | 417/310 |
| 4,637,782 | 1/1987 | Teubler et al. | 417/300 |
| 4,842,490 | 6/1989 | Watanabe et al. | 417/310 |
| 4,890,987 | 1/1990 | Sato et al. | 417/310 |

FOREIGN PATENT DOCUMENTS

| | | |
|---|---|---|
| 3623421 | 1/1988 | Fed. Rep. of Germany . |
| 8806397 | 1/1989 | Fed. Rep. of Germany . |
| 818644 | 8/1959 | United Kingdom . |

*Primary Examiner*—Richard A. Bertsch
*Assistant Examiner*—Alfred Basichas
*Attorney, Agent, or Firm*—Bachman & LaPointe

[57] ABSTRACT

A fluid pump unit has a flow control valve which returns a portion of a working fluid discharged from a pump assembly when rotation speed of a rotor increases to become greater than a predetermined value. The flow control valve includes an essentially cylindrical spool chamber defined in a pump case, and a valve spool movably housed within the spool chamber. The spool chamber has a pair of through openings on the side wall thereof which through openings are selectively open and closed by movement of the spool valve. The pump case is formed with a pair of drain passages which are respectively communicated with the through openings of the spool chamber independently of each other. When rotation speed of a rotor of the pump assembly becomes greater than a predetermined value, the spool valve opens the through openings to return a part of the discharged working fluid to an inlet passage through which working fluid is introduced from a fluid source into the pump assembly.

11 Claims, 4 Drawing Sheets

FLUID PUMP UNIT WITH FLOW CONTROL VALVE

BACKGROUND OF THE INVENTION

1. Field of the Invention

The present invention relates generally to a fluid pump unit serving as a power source of an automotive power steering system or the like. More specifically, the invention relates to a fluid pump unit with a flow control valve which returns excessive discharge to the interior of the fluid pump unit.

2. Description of the Background Art

A fluid pump unit is widely used as a power source of an automotive power steering system. Generally, amount of working fluid discharged from such a fluid pump unit per unit time increases in proportion to increase of the engine speed, since discharge amount is essentially constant per one cycle thereof. On the other hand, in order that automotive power steering systems stably exhibit their performance, required and sufficient working fluid must be supplied thereto. In addition, the required maximum discharge amount of working fluid is determined by the maximum rotation speed of a steering wheel. Therefore, when discharge amount of working fluid exceeds the required maximum value due to increase of the engine speed, the fluid pump unit must be provided with a system, such as a flow control valve, which returns excessive discharge to the interior thereof. This flow control valve causes the amount of working fluid supplied to the power steering system to decrease as the engine speed increases and while the engine speed is relatively high, so that the vehicle will handle stably at high speed.

Flow control valves of this type generally comprise a spool chamber communicated with discharge side of a fluid pump unit, and a valve spool movably housed within the spool chamber. The valve spool moves in response to discharge pressure of the fluid pump unit. Movement of the valve spool is designed to adjust open an area of a drain passage which establishes fluid communication between the discharge side and an inlet side thereof. In this way, when the amount of working fluid discharged from the fluid pump unit becomes greater than a predetermined value, a part of the discharged working fluid returns to the inlet side of the fluid pump unit, so that the amount of working fluid supplied to an external load, such as an automotive power steering system, can be adjusted.

However, in conventional fluid pump units, the spool chamber has only one drain port for the drain passage, and the drain passage branches to two passages on the way to be communicated with the inlet side thereof. Therefore, there is a disadvantage in that abrasion occurs partially on the valve spool and the spool chamber, since the valve spool slides within the spool chamber while it is thrust against the inner wall thereof on the side of the drain port. In addition, there is a disadvantage in that noise occurs due to agitation and cavitation of working fluid at the branching portion of the drain passage.

SUMMARY OF THE INVENTION

It is therefore a principal object of the present invention to provide a fluid pump unit with a flow control valve, which can prevent only a part of the valve spool and spool chamber from being worn out.

It is another object of the present invention to provide a fluid pump unit with a flow control valve, which can prevent noise from occurring due to agitation and cavitation of working fluid.

In order to accomplish the aforementioned and other objects, a fluid pump unit has a flow control valve which returns working fluid from a discharge side of the fluid pump unit to an inlet side thereof. The flow control valve has a plurality of drain passages independent of each other, each of which selectively establishes and blocks fluid communication between the discharge and inlet sides of the fluid pump unit for returning working fluid from the discharge side to the inlet side when pressure on the discharge side becomes greater than a predetermined value.

According to one aspect of the present invention, a fluid pump unit is provided comprising: a pump casing defining therein an internal space and having inlet and discharge passages; a pump assembly housed within the internal space of the pump casing, the pump assembly receiving working fluid from a fluid source through the inlet passage and discharging pressurized working fluid to a pressure chamber formed between the pump casing and the pump assembly for supplying the pressurized working fluid to an external load through the discharge passage; a flow control valve having a spool chamber defined in the pump casing, and a valve spool movably housed within the spool chamber, the spool chamber being communicated with the pressure chamber and having a plurality of through openings, the valve spool movable within the spool chamber from a first position in which the valve spool closes the through openings to a second position in which the valve spool opens the through openings when pressure within the pressure chamber becomes greater than a predetermined value; and a plurality of drain passages formed in the pump casing and being respectively communicated with the through openings of the spool chamber independently of each other, the drain passages selectively establishing and blocking fluid communication between the spool chamber and the inlet passage by movement of the valve spool for returning a part of the pressurized working fluid in the pressure chamber to the inlet passage when the valve spool opens the through openings of the spool chamber.

According to another aspect of the present invention, a fluid pump unit comprises: a pump casing defining therein an internal space and having inlet and discharge passages; a pump assembly housed within the internal space of the pump casing and having a rotatable rotor, the pump assembly receiving working fluid from a fluid source through the inlet passage and discharging pressurized working fluid to a pressure chamber formed between the pump casing and the pump assembly for supplying the latter to an external load through the discharge passage, the amount of the pressurized working fluid from the pump assembly increasing as rotation speed of the rotor increases; a flow control valve having a spool chamber defined in the pump casing, and a valve spool movably housed within the spool chamber, the spool chamber being communicated with the pressure chamber and having a plurality of through openings, the valve spool moving within the spool chamber from a first position in which the valve spool closes the through openings to a second position in which the valve spool opens the through openings when rotation speed of the rotor becomes greater than a predetermined value; and a plurality of drain passages formed in the pump casing and being respectively communicated with the through openings of the spool chamber independently of each other, the drain passages selectively establishing and blocking fluid communication between the spool chamber and the inlet passage by movement of the valve spool for returning a part of the pressurized working fluid in the pressure chamber to the inlet passage when the valve spool opens the through openings of the spool chamber.

According to further aspect of the present invention, a fluid pump unit comprises: a pump casing defining therein an internal space and having inlet and discharge passages; a pump assembly housed within the internal space of the pump casing, the pump assembly receiving working fluid from a fluid source through the inlet passage to discharge pressurized working fluid to an external load through the discharge passage; and a flow control valve which returns working fluid from a discharge side of the pump assembly to the inlet passage, the flow control valve having a plurality of drain passages independent of each other, each of which selectively establishes and blocks fluid communication between the discharge side of the pump assembly and the inlet passage for returning working fluid from the discharge side to the inlet passage only when a flow rate of working fluid discharged from the pump assembly becomes greater than a predetermined value.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENT

Figure 1:
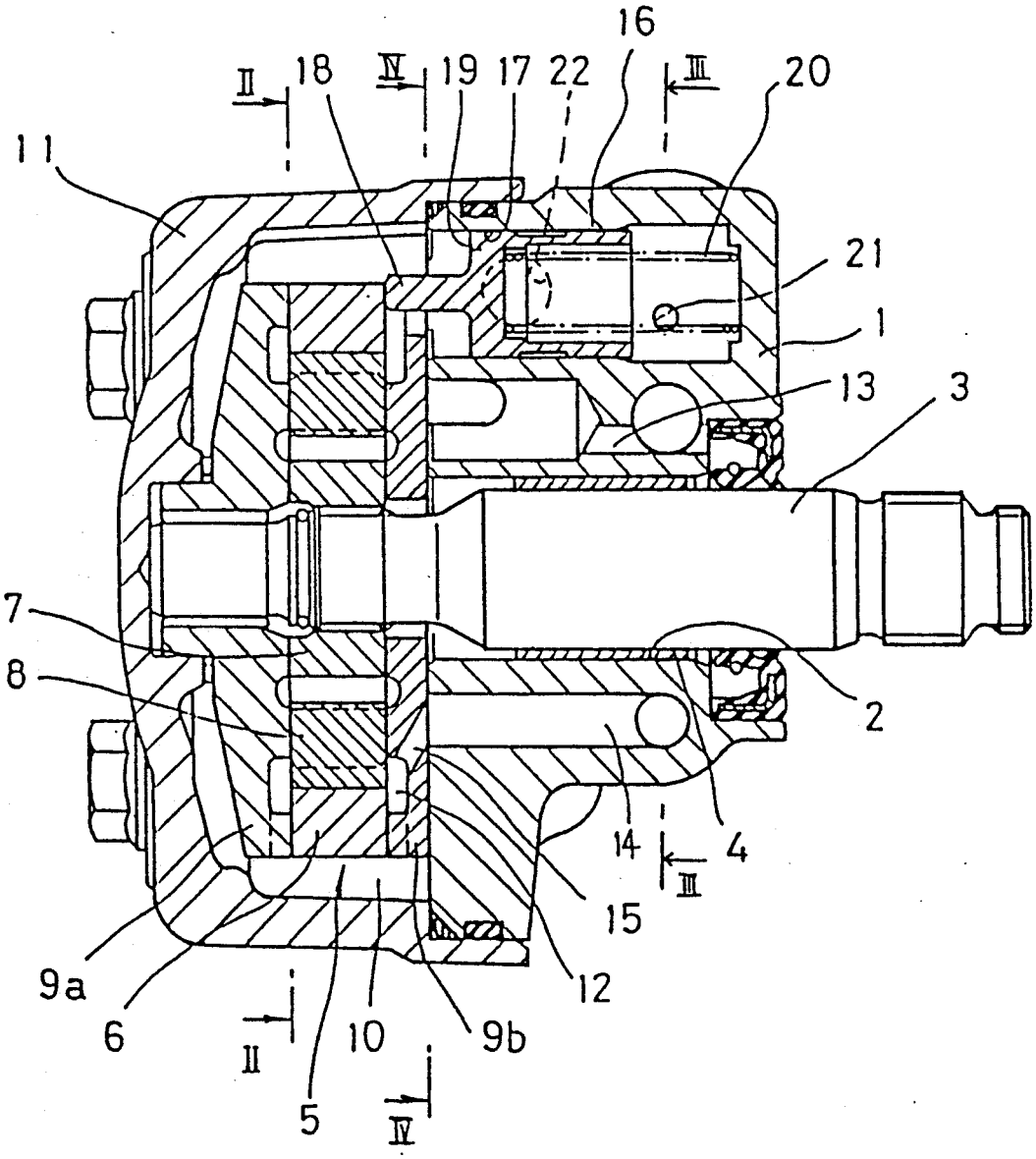
FIG. 1 shows a longitudinal cross-section of the preferred embodiment of a fluid pump unit, according to the present invention.

Referring now to the drawings, particularly to FIG. 1, there is shown the preferred embodiment of a fluid pump with a flow control valve, according to the present invention.

Figure 2:
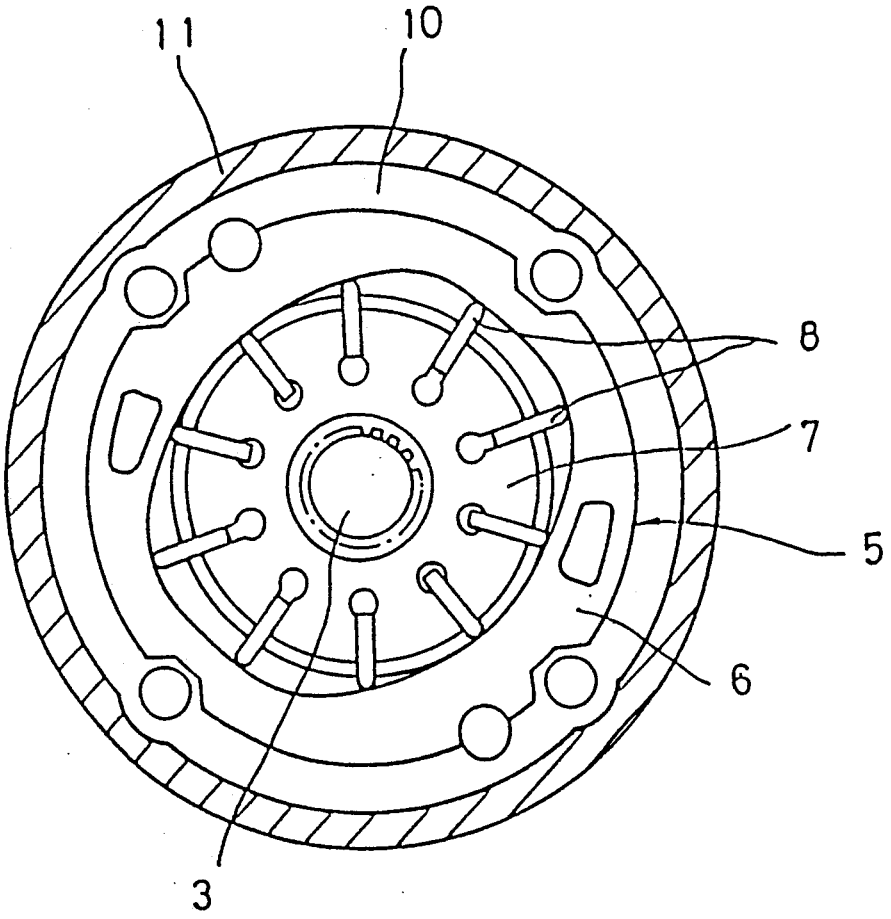
FIG. 2 is a sectional view of the fluid pump unit of FIG. 1, which is taken along the line II—II of FIG. 1.

As shown in FIG. 1, the fluid pump has a pump case 1 which defines a central cylindrical portion or axial bore 2. A pump shaft 3 is received in the axial bore 2, and is rotatably supported thereon via a bearing 4. The inwardly located end portion of the pump shaft 3 is connected to a pump assembly 5 which comprises a cam ring 6, an essentially cylindrical rotor 7, a plurality of vanes 8 and front and back plates 9*a* and 9*b* for forming a rotary vane pump. The front and back plates 9*a* and 9*b* are arranged on both sides of the cam ring 6 to form therein a space having a substantially elliptical cross-section as can be seen clearly from FIG. 2. The rotor 7 is rotatably supported on the end portion of the pump shaft 3, and is housed within the space formed by the cam ring 6 and the plates 9*a* and 9*b* so as to form a pair of working chambers defined by the cam ring 6, the rotor 7 and the plates 9*a* and 9*b*. Each of the vanes 8 is received within a groove formed in the rotor 7 so as to move radially. When the pump shaft 3 rotates, centrifugal force produced by rotation of the rotor 7 is subjected to the vanes 8 so that the vanes 8 move radially to project from the rotor 7 to come into contact with the inner surface of the cam ring 6. As a result, the vanes 8 move on the inner surface of the cam ring 6 while it is in contact therewith, so that the volumes defined between the adjoining vanes 8 within the working chambers are changed to perform pumping effect. A cover member 11 is secured to the circumferential surface portion of the pump case 1 to cover the pump assembly 5 to form a pressure chamber 10 therebetween. The pressure chamber 10 is designed to receive the pressurized working fluid from the pump assembly 5 through a discharge passage 12 formed in the plates 9*a* and 9*b*.

The pump case 1 also defines an inlet port 13 which establishes a fluid communication between the working chambers of the pump assembly and a fluid source (not shown), such as a fluid reservoir for introducing working fluid into the working chambers. In addition, the pump case 1 defines a discharge port 14 which is communicated with the pressure chamber 10 via the discharge passage 12 and an orifice formed in the back plate 9*b*. The discharge port 14 is also communicated with an external load (not shown), such as an automotive power steering unit, for supplying the pressurized working fluid.

Figure 3:
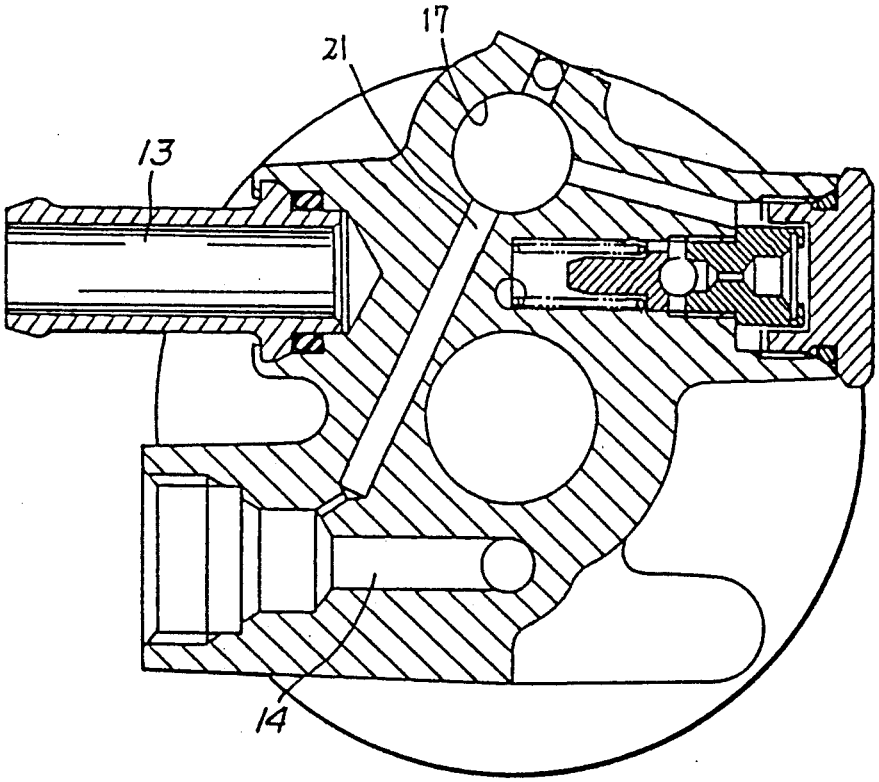
FIG. 3 is a sectional view of the fluid pump unit of FIG. 1, which is taken along the line III—III of FIG. 1.

A flow control valve 16 extending essentially parallel to the axis of the pump shaft 3 is provided within the pump case 1. The flow control valve 16 generally comprises a spool chamber 17 defined in the pump case 1, and a valve spool 19 movably housed within the spool chamber 17. The spool chamber 17 has a through opening which directly opens to the pressure chamber 10 at one end thereof. The valve spool 19 is integrally formed with a stopper projection 18 which extends in a direction of the axis of the valve spool 19 from the front surface thereof. The valve spool 19 is biased toward the pump assembly 5 by means of a bias spring 20, so that the stopper projection passes through the through an opening of the spool chamber 17. The spool chamber 17 also has a pressure induction port 21 and a pair of pressure relief passages or drain passages 22. As can be seen clearly from FIG. 3, the pressure induction port 21 establishes fluid communication between the spool chamber 17 and the discharge port 14 so as to introduce working fluid passing through the orifice 15 into the spool chamber 17. When the pressure difference between the front and back sides of the orifice 15 becomes greater than a predetermined value, the valve spool 19 moves to the right (FIG. 1) against the biasing force of the bias spring 20. When the valve spool 19 moves to the right by a predetermined distance, the drain passages 22 are respectively designed to establish fluid communication between the spool chamber 17 and the inlet port 13 to return a part of the discharge fluid from the pressure chamber 10 (the pump discharge side) to the inlet port 13 (the pump inlet side).

Figure 4:
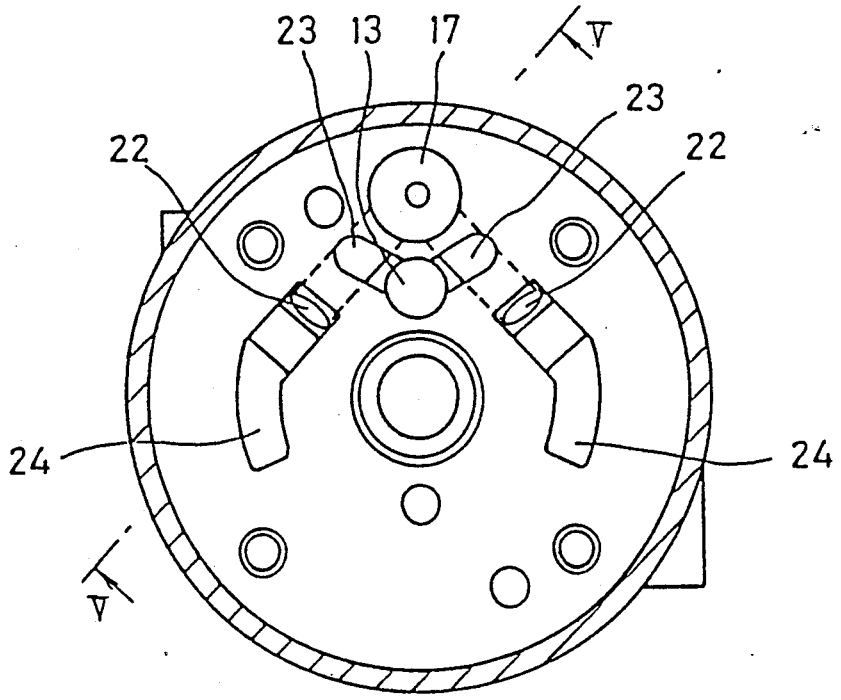
FIG. 4 is a sectional view of the fluid pump unit of FIG. 1, which is taken along the line IV—IV of FIG. 1.
Figure 5:
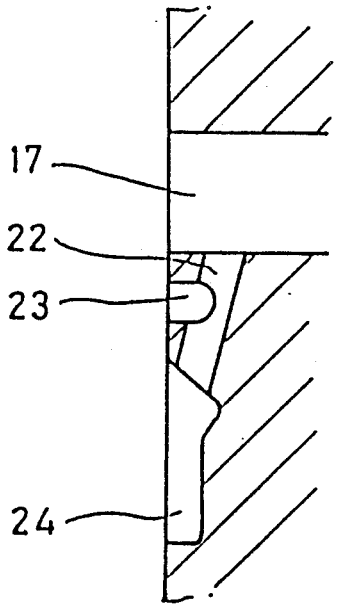
FIG. 5 is a sectional view of the fluid pump unit of FIG. 1, which is taken along the line V—V of FIG. 4.

As can be seen clearly from FIG. 4, the pair of drain passages 22 are arranged symmetrically. The drain passages 22 are communicated with the inlet port 13 via a pair of grooves 23, respectively. In addition, as can be seen clearly from FIG. 5, the drain passages 22 are communicated with the interior of the pump assembly 5 via a pair of fluid trap portions 24 and a pair of inlets (not shown) formed in the back plate 9*b*, respectively.

According to the present invention, since the spool chamber 17 has a pair of drain passages 22, thrusting force by which the valve spool 19 is thrust against the side wall of the spool chamber 17 is not only decreased, but it is also possible to prevent abrasion from occurring between the valve spool 19 and the spool chamber 17. In addition, since the drain passages 22 are formed in the spool chamber 17 independently of each other to have no junctions or branches, working fluid can stably flow through the drain passages 22, so that it is possible to prevent noise from occurring due to agitation or cavitation of the working fluid.

With this construction, the operation of the preferred embodiment of a fluid pump unit, according to the present invention, is described below.

In a case where the drain passage 20 is closed by the spool valve 19, as rotation speed of the fluid pump unit (rotation speed of the pump shaft 3) increases, the amount of the working fluid discharged from the pump assembly 5 increases to be proportional to increase of rotation speed thereof since it is constant per one cycle thereof. As a result, the pressure within the pressure chamber 10, or discharge pressure of the fluid pump unit, also increases. When rotation speed of the fluid pump unit is less than a predetermined value, i.e. when the discharge pressure thereof is less than a biasing force of the bias spring 20 by which the valve spool 19 is biased, the drain passage 20 remains closed by the valve spool 19. Therefore, in this condition, the amount of working fluid discharged from the fluid pump unit increases proportional to increase of rotation speed thereof.

When the rotation speed of the fluid pump unit becomes greater than the predetermined value, the pressure difference between the front and back sides of the orifice 15 becomes greater. As a result, the discharge pressure becomes greater than the biasing force of the bias spring 20 so that the valve spool 19 moves against the bias spring 20 to the right (FIG. 1), thereby opening the drain passage 22. As a result, a part of the discharge amount of the fluid pump unit returns to the inlet port 13 through the drain passage 22, and the rest is discharged from the discharge port 14.

As mentioned above, according to the present invention, a plurality of drain passages, each of which establishes fluid communication between the spool chamber and the inlet side of the fluid pump unit, are provided independently of each other. Therefore, it is possible not only to decrease abrasion of the valve spool and spool chamber due to sliding of the valve spool within the spool chamber, but also to prevent noise or abnormal sounds from occurring due to cavitation and so forth. Accordingly, it is possible to provide a fluid pump unit which has a superior durability and can operate silently.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A fluid pump unit comprising:

a pump casing defining therein an internal space and having inlet and discharge passages;

a pump assembly housed within the internal space of the pump casing, said pump assembly receiving working fluid from a fluid source through said inlet passage and discharging pressurized working fluid to a pressure chamber formed between said pump casing and said pump assembly for supplying said pressurized working fluid to an external load through said discharge passage;

a flow control valve having a spool chamber defined in said pump casing, and a valve spool movably housed within said spool chamber, said spool chamber being communicated with said pressure chamber and having a plurality of through openings, said valve spool movable within said spool chamber from a first position in which said valve spool closes said through openings to a second position in which said valve spool opens said through openings when pressure within said pressure chamber becomes greater than a predetermined value; and a plurality of drain passages formed in said pump casing independently of each other, and being respectively communicated with said through openings of the spool chamber, said drain passages having open ends opening to said spool chamber directed essentially in a radial direction with respect to the axis of said spool chamber, said opening ends of said drain passages being arranged in circumferential alignment and at mutually different angular positions so as to exert fluid pressure onto said valve spool at mutually different angular orientation, said open ends of said drain passages being selectively opened and closed according to axial position of said valve spool for returning a part of the pressurized working fluid in said pressure chamber to said inlet passage when said valve spool opens said through openings of the spool chamber.

2. A fluid pump unit as set forth in claim 1, wherein said drain passages are so arranged as to separate from each other at a predetermined angle on a transverse section of the valve spool so as to prevent the outer surface of the valve spool and the inner surface of the spool chamber from being subjected to abrasion due to movement of the valve spool relative to the spool chamber.

3. A fluid pump unit as set forth in claim 1, wherein the number of said through openings is two, and one of said drain passages is arranged at a predetermined angle relative to the other drain passage on a transverse section of the fluid pump unit so as to prevent the outer surface of the valve spool and the inner surface of the spool chamber from being subjected to abrasion due to movement of the valve spool relative to the spool chamber.

4. A fluid pump unit as set forth in claim 1, wherein one end of said spool chamber is communicated with said pressure chamber, and said valve spool is biased by means of a spring toward said pressure chamber.

5. A fluid pump unit as set forth in claim 4, wherein said spool chamber and said valve spool are essentially cylindrical, and said through openings are formed in the side surface of said spool chamber.

6. A fluid pump unit as set forth in claim 5, wherein said valve spool moves against the biasing force of said spring to open said through openings when pressure within said pressure chamber becomes greater than a predetermined value.

7. A fluid pump unit comprising:

a pump casing defining therein an internal space and having inlet and discharge passages;

a pump assembly housed within said internal space of the pump casing and having a rotatable rotor, said pump assembly receiving working fluid from a fluid source through said inlet passage and discharging pressurized working fluid to a pressure chamber formed between said pump casing and said pump assembly for supplying the latter to an external load through said discharge passage, the amount of the pressurized working fluid from said pump assembly increasing as rotation speed of said rotor increases;

a flow control valve having a spool chamber defined in said pump casing, and a valve spool movably housed within said spool chamber, said spool chamber being communicated with said pressure chamber and having a plurality of through openings, said valve spool moving within said spool chamber from a first position in which said valve spool closes said through openings to a second position in which said valve spool opens said through openings when rotation speed of said rotor becomes greater than a predetermined value; and a plurality of drain passages formed in said pump casing independently of each other, and being respectively communicated with said through openings of the spool chamber, said drain passages having open ends opening to said spool chamber directed essentially in a radial direction with respect to the axis of said spool chamber, said opening ends of said drain passages being arranged in circumferential alignment and at mutually different angular positions so as to exert fluid pressure onto said value spool at mutually different angular orientation, said open ends of said drain passages being selectively opened and closed according to axial position of said valve spool for returning a part of the pressurized working fluid in said pressure chamber to said inlet passage when said valve spool opens said through openings of the spool chamber.

8. A fluid pump unit comprising:

a pump casing defining therein an internal space having inlet and discharge passages;

a pump assembly housed within the internal space of the pump casing, said pump assembly receiving working fluid from a fluid source through said inlet passage and discharging pressurized working fluid to a pressure chamber formed between said pump casing and said pump assembly for supplying said pressurized working fluid to an external load through said discharge passage;

a flow control valve having a spool chamber defined in said pump casing, said valve spool chamber defined in said pump casing, and a valve spool movably housed within said spool chamber, said spool chamber being communicated with said pressure chamber and having a plurality of through openings, said valve spool movable within said spool chamber from a first position in which said valve spool closes said through openings to a second position in which said valve spool opens said through openings when pressure within said pressure chamber becomes greater than a predetermined value;

a draining means for draining part of the high pressure working fluid within said pressure chamber and returning to said inlet passage, said draining means including at least first and second drain passages respectively opening to said spool chamber in circumferential alignment and at mutually different angular positions with respect to said spool chamber, the opening end of said first and second drain passages being so oriented as to reduce local bias for said valve spool at closing position; and said valve spool selectively establishing and blocking fluid comunication between said pressure chamber and said inlet passage through said drain means and said spool chamber.

9. A fluid pump unit comprising:

a pump casing defining therein an internal space having inlet and discharge passages;

a pump assembly housed within the internal space of the pump casing, said pump assembly receiving working fluid from a fluid source through said inlet passage and discharging pressurized working fluid to a pressure chamber formed between said pump casing and said pump assembly for supplying said pressurized working fluid to an external load through said discharge passage;

a flow control valve having a spool chamber defined in said pump casing, said valve spool chamber defined in said pump casing, and a valve spool movably housed within said spool chamber, said spool chamber being communicated with said pressure chamber and having a plurality of through openings, said valve spool movable within said spool chamber from a first position in which said valve spool closes said through openings to a second position in which said valve spool opens said through openings when pressure within said pressure chamber becomes greater than a predetermined value;

a draining means for draining part of the high pressure working fluid within said pressure chamber and returning to said inlet passage; said draining means including at least first and second drain passages respectively having first opening end opening to said spool chamber in circumferential alignment and at mutually different angular positions with respect to said spool chamber, each of said first and second drain passages having another second opening end opening to said inlet passage, said first opening end of said first and second drain passages being so oriented as to reduce local bias for said valve spool at closing position due to local unbalance of the fluid pressure therein; and said valve spool selectively establishing and blocking fluid communication between said pressure chamber and said inlet passage through said drain means and said spool chamber.

10. A fluid pump unit comprising:

a pump casing defining therein an internal space having inlet and discharge passages;

a pump assembly housed within the internal space of the pump casing, said pump assembly receiving working fluid from a fluid source through said inlet passage and discharging pressurized working fluid to a pressure chamber formed between said pump casing and said pump assembly for supplying said pressurized working fluid to an external load through said discharge passage;

a flow control valve having a spool chamber defined in said pump casing, said valve spool chamber defined in said pump casing, and a valve movably housed within said spool chamber, said spool chamber being communicated with said pressure chamber and having a plurality of through openings, said valve spool movable within said spool chamber from a first position in which said valve spool closes said through openings to a second position in which said valve spool opens said through openings when pressure within said pressure chamber becomes greater than a predetermined value; and a plurality of drain passages formed in said pump casing independently of each other, and being respectively communicated with said through openings of the spool chamber, said drain passages of said valve spool for returning a part of the pressurized working fluid said pressure chamber to said inlet passage when said valve spool opens said through openings of the spool chamber;

a plurality of recirculating passages communicated with said pressure chamber at one end and communicated with said drain passage at the other end so as to recirculate part of pressurized fluid in said pressure chamber to said drain passage; and a common inlet port communicating with respective of said drain passages for recirculating the pressurized fluid toward inlet passage.

11. A fluid pump unit as set forth in claim 10, wherein each of said recirculation passages includes a fluid trap chamber.

* * * * *